US005388282A

United States Patent [19]

Cherry

[11] Patent Number: 5,388,282

[45] Date of Patent: Feb. 14, 1995

[54] HYDRO-PNEUMATIC FLUSH SYSTEM FOR TOILETS

[76] Inventor: Mark A. Cherry, 965A Jamacha Rd., El Cajon, Calif. 92019

[21] Appl. No.: 216,601

[22] Filed: Sep. 27, 1993

Related U.S. Application Data

[63] Continuation-in-part of Ser. No. 826,148, Jan. 27, 1992.

[51] Int. Cl.[6] ..... E03D 1/00

[52] U.S. Cl. ..... 4/300; 4/236; 4/250; 4/415

[58] Field of Search ..... 4/255.01, 255.02, 255.11, 4/255.12, 300, 661, 234, 235, 236, 240, 242.1, 249, 250, 316, 330, 331, 335, 338, 356, 359, 362, 378, 379, 394, 408, 411, 413, 415

[56] References Cited

U.S. PATENT DOCUMENTS

| | | | |
|---|---|---|---|
| 1,381,710 | 6/1921 | Krantz et al. | 4/250 |
| 2,016,412 | 10/1935 | Winding | 4/234 |
| 2,155,286 | 4/1939 | Winding | 4/234 |
| 2,754,521 | 7/1956 | Marcum | 4/394 X |
| 3,831,204 | 8/1974 | Cook | 4/394 |
| 4,458,368 | 7/1984 | Webb | 4/255.11 |
| 4,922,555 | 5/1990 | Bonilla et al. | 4/255.11 |
| 5,153,948 | 10/1992 | Smith et al. | 4/394 X |
| 5,195,189 | 3/1993 | Gibb | 4/394 X |

FOREIGN PATENT DOCUMENTS

| | | | |
|---|---|---|---|
| 1134486 | 4/1957 | France | 4/240 |

*Primary Examiner*—William A. Cuchlinski, Jr.
*Assistant Examiner*—Willie Morris Worth
*Attorney, Agent, or Firm*—William H. Maxwell

[57] ABSTRACT

A pneumatic assisted flush system for toilets having a raised water storage tank and a flush valve discharging into a toilet bowl, characterized by a primary air seal at the rim of the toilet bowl and a secondary air seal established in a flush passage during flushing, whereby the toilet bowl is converted into a closed chamber for the entrapment of air compressed by the discharge of flush water, thereby depressing debris laden water in the toilet bowl in order to initiate syphoning through a flush pipe and into a sewer.

14 Claims, 3 Drawing Sheets

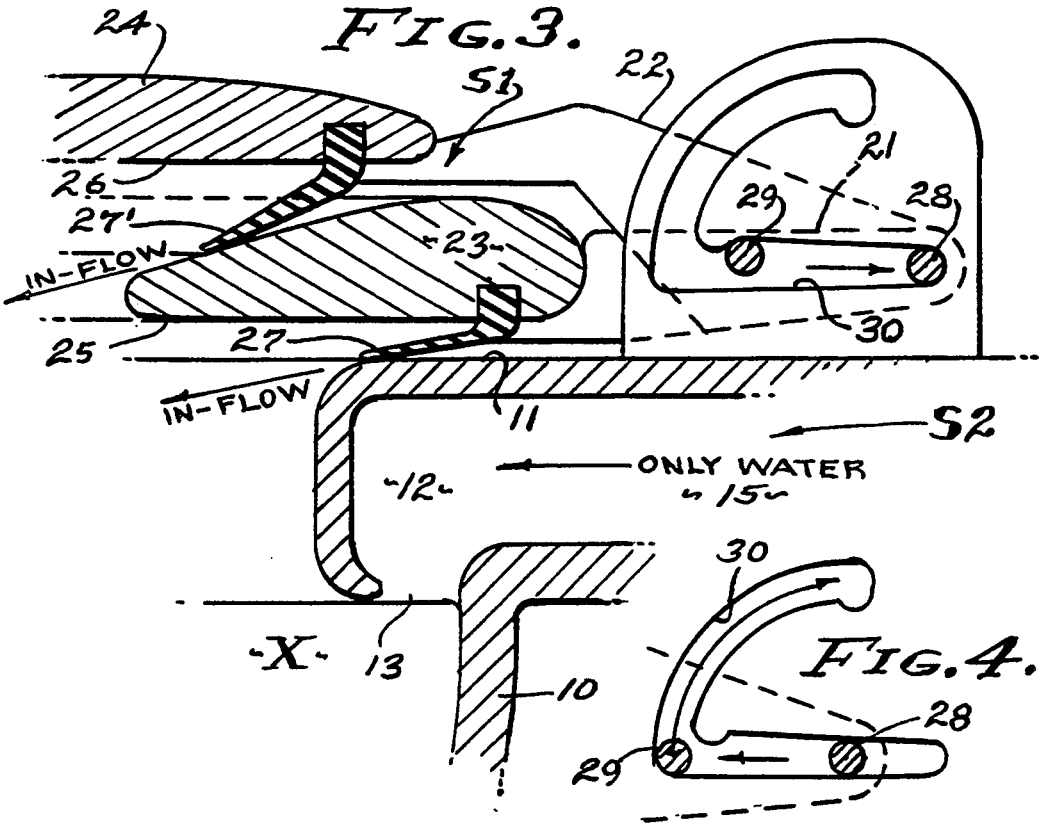
FIG. 3.
24
51
22
21
26
29
28
27'
23
IN-FLOW
30
25
27
IN-FLOW
11
S2
ONLY WATER
12
15
30
X
13
10
FIG. 4.
28
29
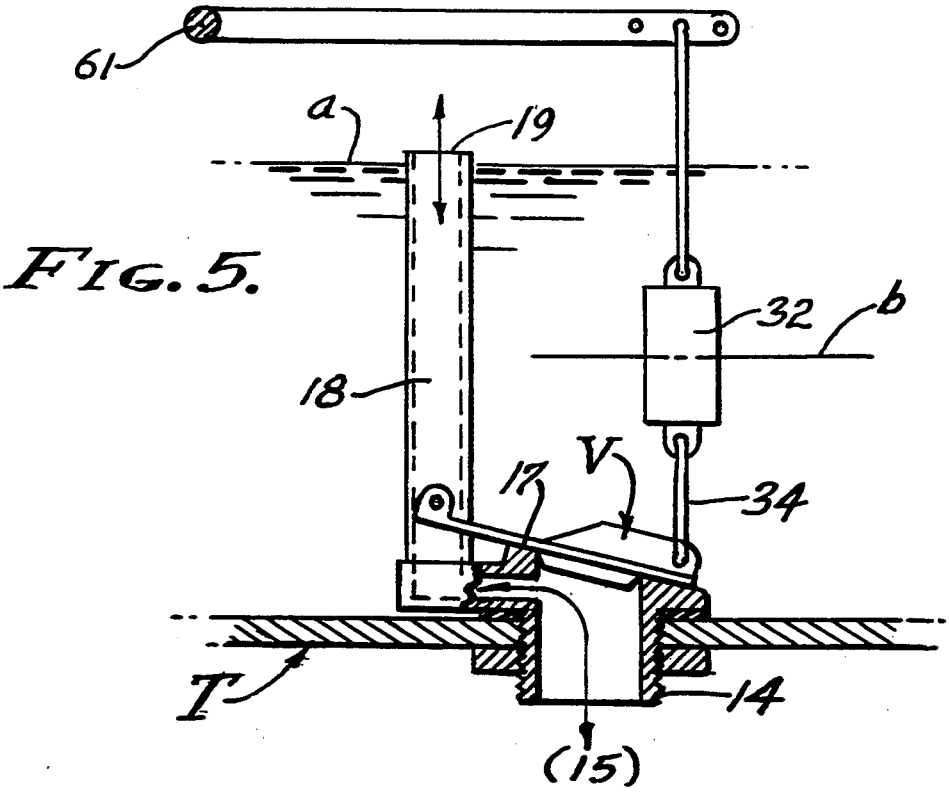
61
a
19
FIG. 5.
32
b
18
V
17
34
T
14
(15)

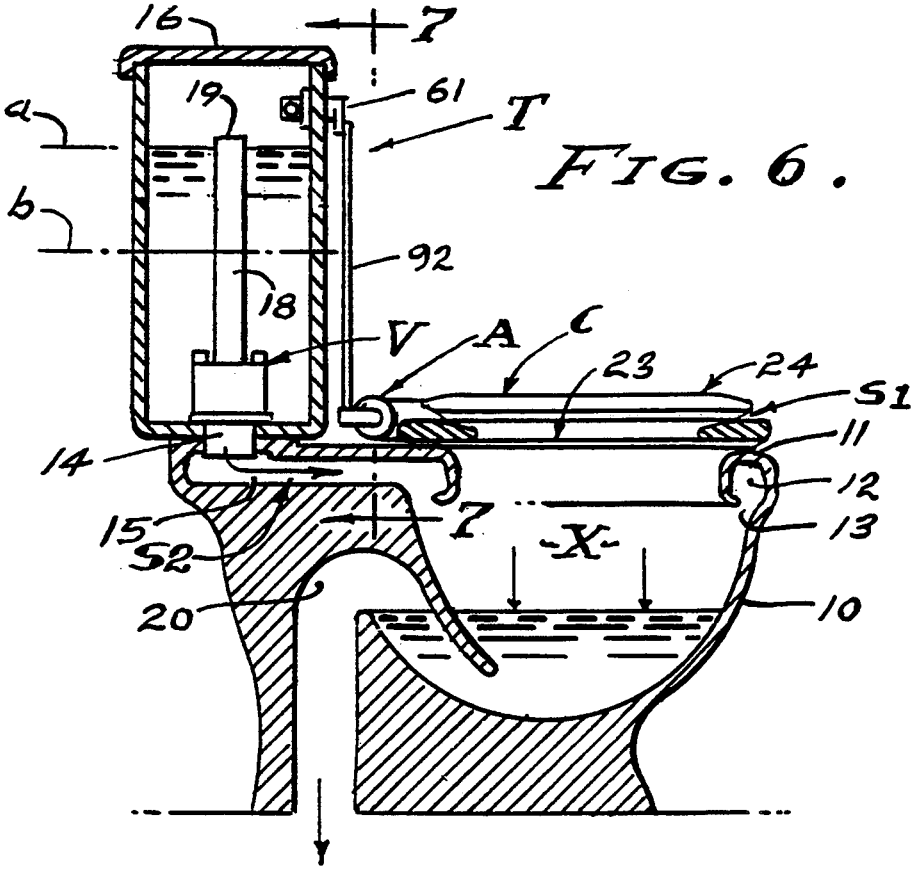
FIG. 6.
FIG. 8. -SEAT UP-
FIG. 9. -VALVE SEATED-
FIG. 10. -SEAT DOWN-
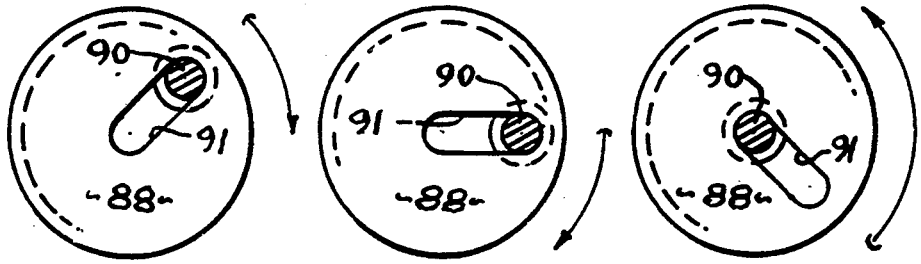
FIG. 7.
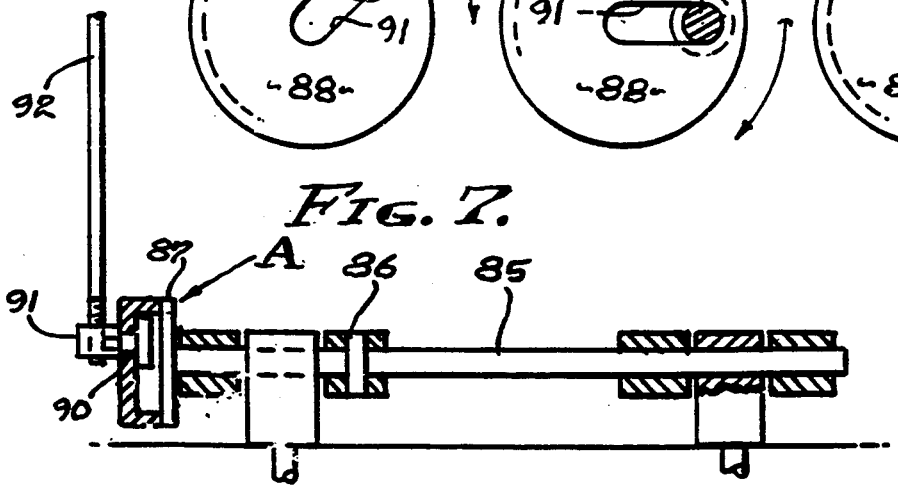

HYDRO-PNEUMATIC FLUSH SYSTEM FOR TOILETS

This is a continuation-in-part of copending application Ser. No. 07/826,148, filed Jan. 27, 1992.

BACKGROUND OF THE INVENTION

This invention relates to the flushing of toilets and to the conservation of water involved therewith. Heretofore, water has been the sole medium employed in the operation of toilets in the disposal of sewage waste, particularly domestic toilets operating entirely by means of a hydraulic water supply. That is, the ordinary prior art toilet operates entirely by the fall of a head of water from a raised storage tank, or by equivalent means, whereby the water level rises in and rinses the toilet bowl, followed by a syphoning effect that draws a full tank of water and entrained waste over a trap and into a sewer line. It is a general object of this invention to utilize the initial discharge of storage tank water to cause pneumatic pressurization of the toilet bowl to thereby initiate syphoning of waste laden water.

In practice, the volume of toilet flush water is minimized to only that which is necessary to ensure a full flush plus sufficient water to maintain clear sewage lines. Prior art toilet flushing systems have relied exclusively upon the sudden release of a substantial volume of water from an elevated storage tank, or the like. The hydraulic principles involved include rinsing and filling the toilet bowl and to establish an air trap that isolates the sewage line, these functions being retained in the practice of this invention. However, it is also an object herein to employ pneumatics to intitiate and to carry out the flushing functions with the use of water reserved to rinsing and filling the toilet bowl to its passive readiness for subsequent flushing. A characteristic feature of this invention is the closable chamber over the water level in the toilet bowl, and means to pressurize said chamber with air in order to initiate and to consumate flushing. Accordingly, it is another object of this invention to provide a seat and/or cover means releasably sealing said chamber to access. In carrying out this invention, the seat is opened by the cover for normal use by a person, following which it is closed and sealed by the cover and to the rim of the toilet bowl. It is in this sealed condition that flushing is initiated by the introduction of a charge of water into the closed chamber.

An existent and necessary feature of prior art toilets is the vent opening from the toilet bowl into the storage tank above the water level therein, providing an overflow into the bowl and to the sewer waste line. The vent opens below a flush valve and into a flush passage, for communication between the storage tank and toilet bowl when the flush valve is closed. However, when the flush valve is opened and floods the flush passage an air seal is formed in said passage while permitting free discharge of storage tank water. It is an object of this invention to control this vent, usually in the form of a standpipe, so that the aforementioned bowl chamber can be pressurized. In practice, a hydraulic occlusion is established in the flush passage to prevent air exhaust therethrough while permitting tank water to flow toward and into the bowl.

A prerequisite of this flushing system is the seat to toilet bowl seal, it being an object herein to provide sealing means to close the toilet bowl chamber and preferably to control air flow so as to permit free entry of surrounding atmosphere after syphoning is initiated.

A feature of this flushing system is the limited use of water, it being an object to provide water volume control whereby a predetermined volume of water is utilized to rinse and fill the toilet bowl after each flushing. It is feasible to rely upon existent water held passively in the bowl for flushing into the sewer waste pipe, the storage tank water being reserved to refill said bowl after flushing is completed.

A characteristic of this flushing system is the use of air pressure to initiate flushing, it being an object herein to pneumatically augment the hydraulic function so as to accelerate the actual flushing function that it initiates.

A prerequisite of this flushing system is the sealed bowl chamber that is opened for access, it being an object herein to provide means to releasably seal said chamber so as to be air tight. As shown in the drawings and as hereinafter described, it is an object to force flush the toilet bowl chamber by pneumatic pressure resulting from the discharge of storage tank water into the toilet bowl chamber sealed against outside atmosphere. Accordingly, the sudden and substantially increased volume of water in the sealed toilet bowl chamber augments the downward gravitational force of the storage tank flush water discharge, that quickly initiates syphoning without undue agitation and/or stirring of waste and/or debris. Note that agitation can defeat complete flushing of waste in most prior art toilets.

A characteristic feature of this invention is the sealed toilet bowl chamber. It is the primary air seal of the toilet seat and cover which is most evident and which presents two controlling conditions, a closed condition and an open condition. And, it is a secondary air seal which is unobvious and established herein by the vent pipe and flush passage relationship that cooperate when flooded with the flow of flush tank water that inherently establishes pneumatic closure or occlusion to atmosphere. Accordingly, it is an object of this invention to coordinate the opened and closed conditions of the toilet bowl cover in order to operate the toilet flush valve after using the toilet and through the process of closing the cover to seal the toilet bowl chamber. This process enforces immediate flushing and closure of the toilet bowl for sanitary purposes, while opening of the cover remains a passive operation . Closing the cover results in flushing the toilet bowl when the flush valve is operated.

SUMMARY OF THE DISCLOSURE

This invention is characterized by pneumatic force applied to the hydraulic flushing of toilets, whereby far less water is used in flushing waste water into the sewer. Gravitational discharge of storage tank water pressurizes the entrapped toilet bowl chamber air by means of primary and secondary air seals that close said chamber for air compression upon sudden increase in water volume within said chamber. There is a primary air seal at the rim of the toilet bowl, and there is a secondary air seal in the flush passage between the toilet bowl and the riser vent into the storage tank. This air entrapment initiates syphoning by depressing the waste water level without unduly agitating and/or stirring said waste water in the toilet bowl. Consequently,waste water level is depressed quickly and syphoned off while being replaced by clean storage tank flush and refill water. The operation of this process and system is noticably quiet and effective, and is a low pressure system as distinguished from a high pressure system.

The foregoing and various other objects and features of this invention will be apparent and fully understood from the following detailed description of the typical preferred forms and applications thereof, throughout which description reference is made to the accompanying drawings.

THE DRAWINGS

FIGS. 3 and 4 are enlarged fragmentary views showing the primary seal of the seat and cover to the toilet bowl, and a locking hinge to releasably close the toilet bowl chamber.

FIG. 5 is an enlarge sectional view of the flush valve and vent relationship for communication of the flush passage with the interior of the storage tank.

FIG. 6 is a view similar to FIG. 1 and showing a control embodiment by means of positioning the toilet cover.

FIG. 7 is an enlarged fragmentary view of the cover position and flush valve control means.

Figure 1:
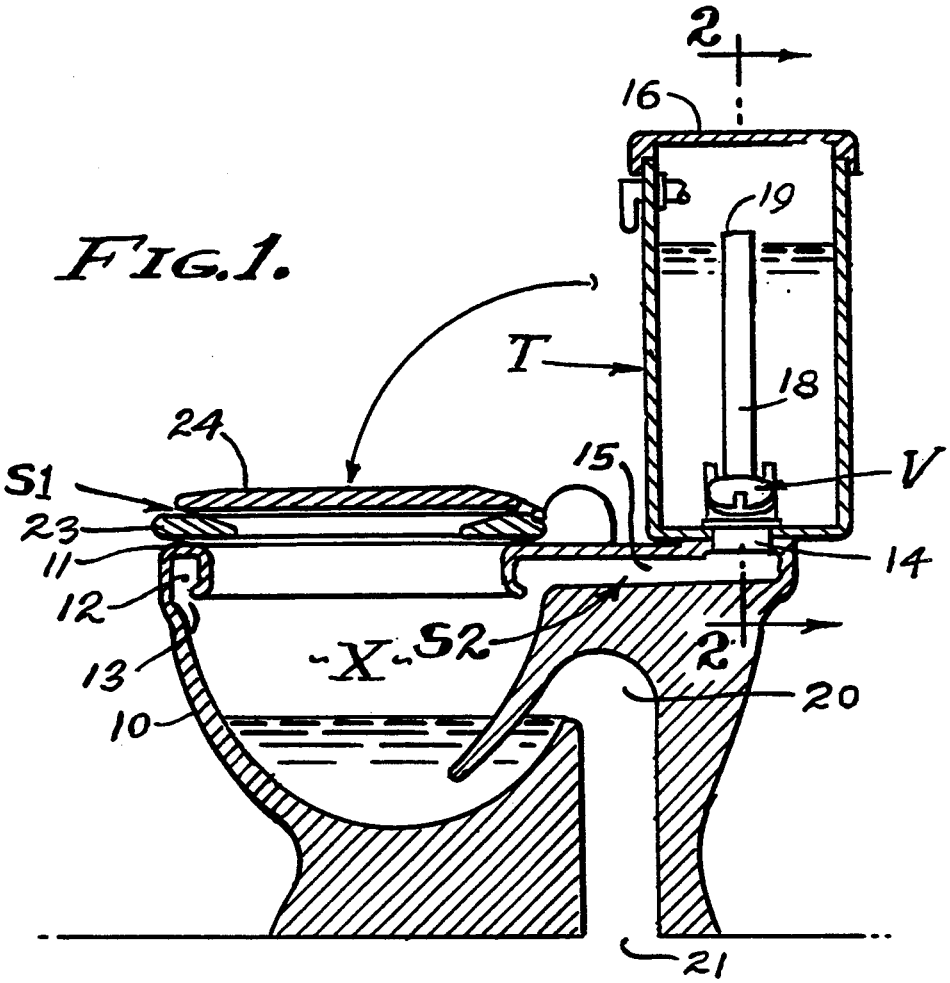
FIG. 1 is a side sectional view of a toilet embodying features of the present invention.

And, FIGS. 8, 9 and 10 are enlarged detailed views of the cover position and flush valve coordinating means showing the "UP" pull condition, the cover "CLOSING" release condition, and the cover "RETURN" reset condition.

PREFERRED EMBODIMENT

Referring now to the drawings, the toilet and water storage tank T are conventional in every respect. As shown, the toilet bowl 10 presents an upwardly open chamber X defined by a horizontal smooth topped rim 11 within which there is a water distribution passage 12 with a circumferential series of discharge ports 13 at the inner periphery of the bowl. The passage 12 is in open communication through a flush passage 15 from a flush pipe 14 that receives rinse and fill water from an elevated storage tank T having an open top closed by a cover 16. The flush pipe 14 has a large capacity valve V and seat opening 17 at the bottom of the tank T and has a smaller capacity vent 18 in the form of a stand-pipe open to atmosphere at 19 above the high water level within the tank. The bottom of the bowl 10 is open through a syphon trap 20 and into the sewer waste line 21. These features 10–21 are all conventional, as clearly shown.

In accordance with this invention, the upwardly open chamber X is closable so as to be sealed against the outside atmosphere, there being two air seals, an air seal means S1 at the rim 11, and an air seal means S2 in the flush passage 15. The seal means S1 is manually operated to close, whereas the seal S2 is automatically closed when flushing occurs. The seal means S1 is a one-way valve that prevents back-flow of air to atmosphere and that permits in-flow. The seal means S2 inherently closes the chamber X to atmosphere as a result of flooding the flush passage 15. Flushing is not impeded after its initiation and is completed by continued syphoning effect through the trap 20.

The air seal means S1 is a seat and cover seal and in-flow valve, directly involving the seat 23 and cover 24, there being a first and second seal. The seat 23 is of ring plan form that overlies the smooth flat topped rim 11, having a bottom face 25 spaced from and opposing the rim, and carried by a hinge bracket 21. This first part of seal means S1 can vary in form and is shown as a simple inwardly disposed flap 27 that coextensively engages the rim 11 surrounding the opening into the bowl 10. The inner lip of seal means S1 is engaged with the rim 11 and is pressured thereagainst by air pressure within the bowl chamber X when it is so charged as will be described. The outer perimeter of seal means S1 is mounted in air tight engagement with bottom face 25 of the seat. This first part of seal means S1 is effective when the seat 23 is lowered into supported engagement with the rim 11 of the toilet bowl 10.

The cover 24 is of Flat plan form and overlies the seat ring, having a bottom face 26 spaced from and opposing a smooth top seating surface of said seat ring, and carried by a hinge bracket. This second part of seal means S1 can vary in form and can be the same as that of the first part above described,and it can be a simple flap type seal 27'. This second part of air seal means S1 is effective when the cover 24 is lowered into supported engagement with the seat ring 23.

The seat and cover 23–24 are releasably held down in a closed condition whereby the bowl chamber X can be pressurized by virtue of the air seal S1 (and S2) being closed to outside atmosphere. The seat and cover 23–24 can be held down by hand or by body weight, or they can be held by pneumatic flush enforcement means comprising a mechanical hinge or latch means. In practice, the time period required to initiate flushing is a short 5 seconds so that only momentary holding down of the seat and cover is required in order to flush the toilet. However, when a positive continued closure is desired, a locking hinge means or latch means is employed as shown in FIGS. 3 and 4, wherein spaced pins 28 and 29 operate in a controlling track 30. When positioned forwardly as shown in FIG. 4 the cover is permitted to swing about pin 28 with the pin 29 free in an arcuate leg of the track 30. When positioned rearwardly as shown in FIG. 3, the cover is locked horizontally in a down position with both pins 28 and 29 in a correspondingly horizontal leg of the track 30.

The air seal means S2 is a vent or flush passage seal, involving the vent 18 from the flush pipe 14 that opens through the flush passage 15 and into the toilet bowl chamber X. The air seal means S2 is a hydraulic occlusion valve that isolates the chamber X from outside atmosphere when the flush passage 15 is flooded with the discharge of storage tank water. When pressure is negative within the chamber X there is unrestricted in-flow of air through the air seal means S1. Accordingly, continued flushing and/or syphoning is not impeded.

A predetermined and limited volume of water is deployed after each flushing operation, to rinse the toilet bowl 10 and to refill the air trap. The volume of water can be controllably restricted as may be required, and it .may be augmented sufficiently as will be necessary to provide adequate water flow to clear the sewer waste line. This is accomplished herein by providing a float 32 responsive to water level in the storage tank T in order to close the flush valve V over the flush seat opening 17, thereby determining a low water level b. There is also a high water level a determined by a float valve F, next described.

The float valve F can be any suitable water level control means as they are available for refilling the toilet tank T as shown and described herein. A water supply 35 enters the bottom of tank T through a suitable standpipe 36, there being a float 37 responsive to the high water level in the tank to close a valve 38 that discharges water into the tank and also a portion into a standpipe vent 18 to ensure thorough rinsing and refilling.

The flush valve V is pressured shut by the head pressure of water rising to the aforesaid height. Note that the flush valve V differs from most prior art flush valves in that it is not bouyant, but rather relies upon the elevated positions of float 32 which is directly responsive to water level in the storage tank T. A link 34 connects the float 32 and flush valve V. A characteristic feature of this flushing system is that the water storage level changes as required from high to low without being completely depleated, so that changes in the volume discharge of water are readily made.

As hereinabove described, the link 34 extends upwardly and connects to the float 32 which is positioned thereby below the high water level a distance establishing the volume of rinse and fill water to be discharged. A feature of this invention is the limited bouyancy of float 32, insufficient to lift said flush valve V held to the seat 17 by the head pressure, and sufficient to sustain a lifted position of said valve off said seat while floating upon said high water level a to a low level b. Note that the low level b is at a substantial distance above the valve seat opening 17, whereby a sufficient head of pressure is provided to sustain closure of said flush valve V during refilling of the storage tank T.

Figure 2:
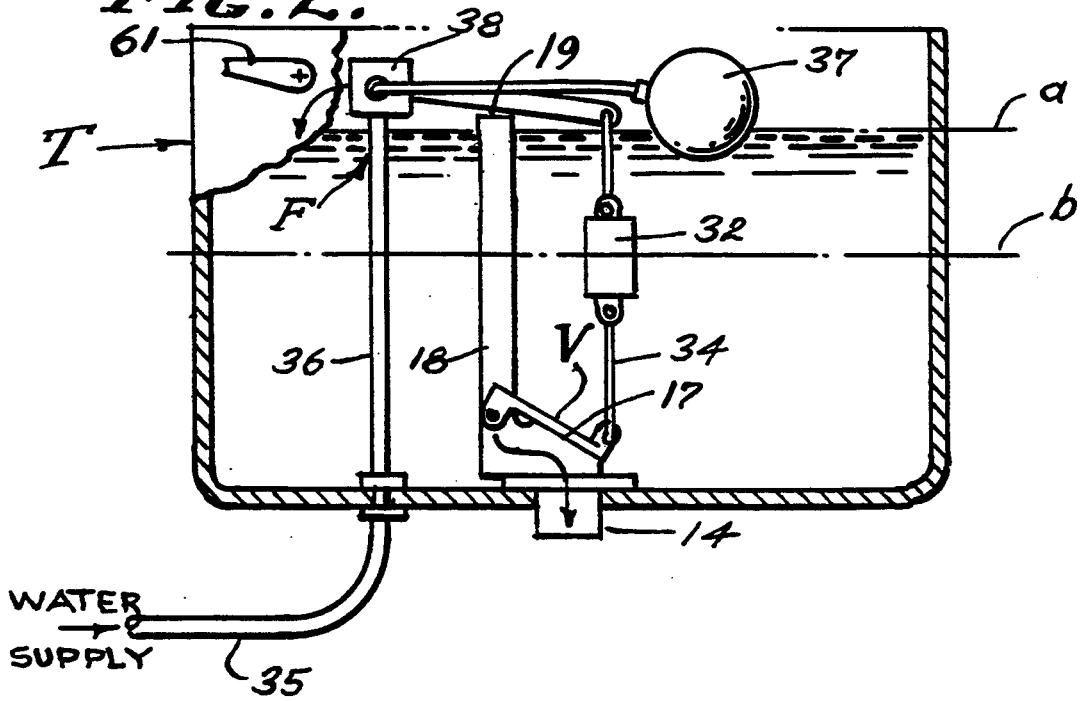
FIG. 2 is an enlarged sectional view of the water storage tank taken as indicated by line 2—2 on FIG. 1, showing the secondary seal passage between the toilet bowl and the vent pipe.

Referring now to the pneumatic flushing control means C as illustrated in FIGS. 1, 6 and 7–10, air pressurization is by means of sudden discharge of flush water into the toilet bowl chamber closed to outside atmosphere by the air seals means S1 and S2. The toilet and water tank T are conventional as hereinabove described and shown in FIGS. 1 and 2 of the drawings, and the seal means S1 is as hereinabove described and as shown in FIG. 3. However, the locking hinge means or latch means is not necessary, since the toilet bowl cover 24 is manually positioned to operatively control flushing, as by holding it closed. Accordingly, the conventional hinge means is employed to independently pivot the toilet seat 23 and the cover 24 (see FIG. 7) so that the cover can be manipulated to open and close the toilet bowl chamber X. A feature of this embodiment is the cover postion and flush valve coordinating means A that controls flushing in response to manual positioning of the cover 24. The air seal means S2 operates automatically. That is, the force flushing means C involves the cooperation and combined functions of the sealed chamber X and simultaneous discharge of flush water thereto that compresses the entrapped air volume.

The cover position and flush valve coordinating means A is a sequencing means that momentarily opens the flush valve V only as and when the cover 24 is being closed, that permits reclosure of the flush valve V when the cover is closed, and that also permits continued closure of the flush valve V when the cover is returned to an open condition ready for subsequent use of the toilet. The usual prior art flush handle 61 is employed to lift the flush valve V through a conventional lever and lift rod system, as shown in FIG. 5.

The coordinating means A can vary in design and is shown herein as a lost motion means coupled to the hinge of the cover 24. Coupling is by means of a shaft 85 rotated through an arc of more than 90° by a key pin 86 to turn a flange 87 at one end thereof. Shaft 85 can carry both the toilet seat 23 and cover 24, as shown. A slotted plate 88 is carried by the flange 87, having a singular slot 91 extending radially from its turning axis coincidental with the axis of shaft 85. A pull pin 90 is captured by its head to slide within the slot between a radially displaced pull position and a centered return position, as shown. The pull pin 90 is carried by a nut 91 threadedly adjusted onto a pull rod 92 pivotally connected to the flush handle 61, in the form of a lever, to depress the same. When the shaft 85 revolves clockwise from its passive 45° position shown in FIG. 8, as a result of manually closing the cover 24, the pin 90 and rod 92 are pulled downward to operate the flush handle 61. After the shaft 85 passes the 90° position shown in FIG. 9 the flush valve V is momentarily lifted from its seat opening 17, and, the slot 91 is then positioned so as to release the pull pin 90 to permit its travel to a center position as shown in FIG. 10. When the shaft 85 reaches approximately 135°, as shown in FIG. 10, the seat 24 is fully closed and the slot 91 is positioned so as to permit said center positioning while permitting return of the plate 88 to said passive 45° position as shown in FIG. 5 without pulling the pin 90 and rod 92. Accordingly, the flush valve V is opened only during closure of the seat cover 24, and remains closed while the cover is held closed during flushing, and is held closed subsequently when the cover is reopened for toilet bowl access.

From the foregoing it will been understood that the toilet flush system disclosed herein features pneumatic pressurization of the toilet bowl chamber X by means of hydraulic displacement of air entrapped in said chamber by primary air seal means S1 and secondary air seal means S2. The air seal S1 is implemented by closing the seat 23 and cover 24 into air tight engagement with the rim 11 of the toilet bowl, while the air seal means S2 is automatically implemented by occlusion to atmosphere by means of the flooded condition in the flush passage 15 when storage tank water is discharged therethrough. Introduction of storage tank water into the bowl chamber X increases the air pressure therein and forcefully adds to the gravitational effect of the flush water discharged into said bowl. As a result, the waste water in the toilet bowl is force flushed through the syphon trap 20 with the least amount of agitation and with a minimum volume of flush water.

Having described only the typical preferred forms and applications of my invention, I do not wish to be limited or restricted to the specific details herein set forth but wish to reserve to myself any modifications or variations that may appear to those skilled in the art, as set forth within the limits of the following claims.

I claim:

1. A Hydro-pneumatic force flushing system for toilets having a bowl for the reception of rinse and fill water to a water level therein set by a syphon trap and having a raised water storage tank in which there is a riser vent from said bowl and open to atmosphere above a high water level controlled by a means responsive to water level in the tank and having a normally closed flush valve closing a flush passage opening from said tank and into said bowl, the toilet bowl having an upwardly open rim spaced, substantially above the water level in said bowl to form an air chamber upwardly open to atmosphere and for the reception of waste into the water level therein, the flushing system including;

a primary air seal means for engagement with the bowl rim and preventing any out flow of air from the bowl rim to atmosphere, a secondary air seal means in the flush passage for preventing any out flow of air through the riser vent to atmosphere when flushing, and a flush control means to open the flush valve for discharge of storage tank water through the flush passage and into the toilet bowl, whereby entrapped air in said toilet bowl chamber is pressurized and adds to the gravitational effect of the water discharge to force flush water to syphon through the toilet trap.

2. The hydro-pneumatic toilet flushing system as set forth in claim 1, wherein the primary air seal means is comprised of a member engageable between the upwardly open rim of the toilet bowl and a cover therefor.

3. The hydro-pneumatic toilet flushing system as set forth in claim 1, wherein the primary air seal means is comprised of a first seal member engageable between the upwardly open rim of the toilet bowl and a seat ring overlying the same, and a second seal member engageable between the seat ring and an overlying cover therefor.

4. The hydro-pneumatic toilet flushing system as set forth in claim 2, wherein the primary air seal means member is an inwardly faced flap carried by a seat ring and having a lip coextensively engaged with the upwardly open rim of the toilet bowl to prevent said any out flow of air and to permit in flow of air into the toilet bowl chamber.

5. The hydro-pneumatic toilet flushing system as set forth in claim 3, wherein the first seal member and the second seal member of the primary air seal means are inwardly faced flaps carried by the seat ring and cover respectively, and each having a lip coextensively engaged with the upwardly open rim of the toilet bowl and seat ring respectively, to prevent said any out flow of air from and to permit in flow of air into the toilet bowl chamber.

6. The hydro-pneumatic toilet flushing system as set forth in claim 2, wherein a latch means releasably locks the cover in a down position to engage the member of the primary air seal means.

7. The hydro-pneumatic toilet flushing system as set forth in claim 3, wherein a latch means releasably locks the cover in a down position to engage both the first and the second seal members of the primary air seal means.

8. The hydro-pneumatic toilet flushing system as set forth in claim 1, wherein the secondary air seal means is a flooded condition of the flush passage that prevents out flow of air through the riser vent while permitting free flow of storage tank water therethrough and into the toilet bowl chamber.

9. The hydro-pneumatic toilet flushing system as set forth in claim 1, wherein the flush valve is comprised of a member held normally closed by a head of water in the storage tank, the flush control means being comprised of a lift lever to open said flush valve member and a float connected to said flush valve member by a link and positioned substantially above said flush valve member to float downward to close the flush valve member at a low water level in the storage tank substantially above the closed flush valve member held normally closed.

10. The hydro-pneumatic toilet flushing system as set forth in claim 1, wherein the means responsive to water level in the storage tank is a float valve means for limiting the high water level in the storage tank.

11. The hydro-pneumatic toilet flushing system as set forth in claim 1, wherein the primary air seal means includes a pneumatic flush enforcement means for releasably locking a cover and a seat of the primary air seal means in a horizontal position.

12. The Hydro-pneumatic toilet flushing system asset forth in claim 11, wherein the flush control means is coupled to the cover to open and close the primary air seal and to open the flush valve.

13. The hydro-pneumatic toilet flushing system as set forth in claim 11, wherein the flush control means includes sequencing means opening the flush valve when said cover is closing and closing the flush valve when said cover is closed.

14. The hydro-pneumatic toilet flushing system as set forth in claim 13, wherein the sequencing means is comprised of a radially slotted plate keyed to and rotatable with opening and closing of said cover, and a valve operating pull pin shiftable in the slotted plate to a radial pull position from a central passive return position with the flush valve closed.

* * * * *